US008141830B1

(12) United States Patent
Hudson

(10) Patent No.: US 8,141,830 B1
(45) Date of Patent: Mar. 27, 2012

(54) CORNER POLE BRACKET SYSTEM

(76) Inventor: Robert E. Hudson, Suffolk, VA (US)

( * ) Notice: Subject to any disclaimer, the term of this patent is extended or adjusted under 35 U.S.C. 154(b) by 0 days.

(21) Appl. No.: 13/092,583

(22) Filed: Apr. 22, 2011

(51) Int. Cl.
*A47B 96/06* (2006.01)

(52) U.S. Cl. ..... 248/220.1; 248/346.5; 248/188; 33/408; 52/699; 52/296

(58) Field of Classification Search ..... 248/220.1, 248/346.5, 188; 52/699, 296; 33/408
See application file for complete search history.

(56) References Cited

U.S. PATENT DOCUMENTS

| | | | | |
|---|---|---|---|---|
| 2,086,009 | A * | 7/1937 | Walker | 52/292 |
| 2,445,823 | A * | 7/1948 | Foster | 52/741.15 |
| 2,931,104 | A | 4/1960 | Taylor | |
| 3,096,588 | A | 7/1963 | Cook | |
| 3,127,683 | A | 4/1964 | Garton | |
| 3,127,684 | A | 4/1964 | Ernst | |
| 3,206,854 | A | 9/1965 | Andrews | |
| 3,226,906 | A | 1/1966 | Koerner | |
| 3,520,061 | A | 7/1970 | Wigglesworth | |
| 3,552,698 | A * | 1/1971 | Kinney | 248/158 |
| 4,631,833 | A | 12/1986 | Moye | |
| 4,644,713 | A * | 2/1987 | Lehman | 52/165 |
| 4,689,889 | A | 9/1987 | Reeves | |
| 5,660,013 | A * | 8/1997 | Saldarelli et al. | 52/296 |
| 5,771,646 | A | 6/1998 | DeSouza | |
| 5,901,525 | A * | 5/1999 | Doeringer et al. | 52/835 |
| 6,412,184 | B1 | 7/2002 | Heavner | |
| 6,640,517 | B2 * | 11/2003 | Mitchell | 52/298 |
| 6,742,748 | B1 * | 6/2004 | Gretz | 248/156 |
| 7,624,508 | B2 | 12/2009 | Beck | |
| 7,673,393 | B1 | 3/2010 | Hudson | |
| 7,980,034 | B2 * | 7/2011 | Fehr et al. | 52/297 |
| 8,015,775 | B2 * | 9/2011 | McMullen et al. | 52/834 |
| 2003/0196394 | A1 * | 10/2003 | Hoffman et al. | 52/299 |
| 2008/0301958 | A1 | 12/2008 | Darty | |

* cited by examiner

*Primary Examiner* — Terrell McKinnon
*Assistant Examiner* — Daniel J Breslin
(74) *Attorney, Agent, or Firm* — Wooten & Shaddock, PLC

(57) ABSTRACT

A corner bracket having a base member and a first wall attachment portion that extends substantially perpendicular to the top side of the base member and a second wall attachment portion that extends substantially perpendicular to the top side of the base member, such that a first wall attachment surface of the first wall attachment portion is perpendicular to a second wall attachment surface of the second wall attachment portion. A central bracket member, an inner bracket member, and an outer bracket member each extend from the top side of the base member. The central bracket member is positioned substantially between at least a portion of the inner bracket member and the outer bracket member and a base member edge, two opposing central bracket member edges, an inner bracket member edge, and an outer bracket member edge are each aligned.

10 Claims, 21 Drawing Sheets

CORNER POLE BRACKET SYSTEM

BACKGROUND OF THE INVENTION

1. Field of the Invention

This invention relates generally to improved tools for use in masonry construction, such as the laying of masonry wall units, for example, brick, concrete block, and the like. More particularly, the invention pertains to improved tools that may be used separately or together as a system of masonry corner and wall guides to aid in the proper and efficient construction of brick walls, including brick walls having quoin corners.

2. Description of Related Art

When brick, block, or stone structures are built, it is important that any walls that form the structure are straight and level. Typically, once the framing of a wall has been completed and brick is to be laid, the brick corners are constructed first. Once the corners have been built, corner poles are placed proximate the outside edges were the wall will be constructed and a string or line is stretched between the corner poles to provide a straight reference line to which the courses of brick or block are laid.

The line is initially placed proximate a respective ground level so that an initial line of bricks can be laid. As the wall is built upward, the line can be moved upward on the corner poles so as to provide a straight reference line for each subsequent row of bricks, blocks, or stones.

Certain wall structures include decorative quoin corners. Quoin corners are created when certain corner bricks, blocks, or stones are offset so as to extend beyond the face created by the constructed wall structure in alternating patterns.

SUMMARY OF THE INVENTION

Unfortunately, placing the corner poles in the correct position and then maintaining the corner poles in that position can be difficult. Additionally, current methods for placing corner poles typically require that at least a portion of the brick structure be constructed beforehand. Likewise, when making repairs to existing structures, it can be difficult to accurately place the necessary corner poles.

When, for example, quoin corners are constructed, the positioning of the corner poles must typically be changed so that a straight reference line can be provided for setting the quoin corner blocks. Because of the difficulty this creates, it is common for the blocks that make up the quoin corner to be set without a straight reference line. Alternatively, during construction of a quoin corner wall structure, the wall structure is initially constructed with gaps where the quoin corner blocks are to be placed. Then, when the remaining wall structure has been constructed, the quoin corner blocks are set into the previously constructed portions of the wall structure.

The known methods for constructing quoin corner and other brick or block wall structures are inefficient and can produce inconsistent results.

Thus, the present invention is directed to improved tools that may be used separately or together as a system of masonry corner and wall guides to aid in the proper and efficient construction of brick walls, including brick walls having quoin corners.

It should be appreciated that the corner pole bracket system of the present invention can be used to initially construct a brick wall atop a foundation or to aid in the continued construction or repair of a partially constructed brick wall. If the corner pole bracket system is used in the initial construction of a brick wall, a corner pole bracket can be affixed in a desired position atop a foundation to be used in the initial construction of the brick wall.

If the corner pole bracket system is used in the continued construction or repair of a partially constructed brick wall, the corner pole bracket can be affixed to either the foundation or a portion of the already constructed brick wall.

In various exemplary, nonlimiting embodiments of the present invention, the corner pole bracket system components comprise one or more of an inside corner bracket, and outside corner bracket, and/or a wall bracket. These corner pole brackets may be used separately or together as a system.

In various exemplary, nonlimiting embodiments, the corner brackets comprise a base member comprising an elongate portion of material having a top side and a bottom side, wherein the base member extends to at least a first terminating surface and a second terminating surface, wherein the first terminating surface is perpendicular to the second terminating surface, and wherein the first terminating surface intersects the second terminating surface at base member edge; a first wall attachment portion extending substantially perpendicular to the top side of the base member, wherein the first wall attachment portion includes a first wall attachment surface, wherein the first wall attachment surface of the first wall attachment portion is coplanar with the first terminating surface of the base member, and wherein at least one wall attachment aperture is formed through the first wall attachment portion; a second wall attachment portion extending substantially perpendicular to the top side of the base member, wherein the second wall attachment portion includes a second wall attachment surface, wherein the second wall attachment surface of the second wall attachment portion is coplanar with the second terminating surface of the base member, wherein at least one wall attachment aperture is formed through the second wall attachment portion, and wherein the first wall attachment surface of the first wall attachment portion is perpendicular to the second wall attachment surface of the second wall attachment portion; a central bracket member, wherein the central bracket member extends from the top side of the base member, wherein the central bracket member is in the form of a rectangular prism, and wherein the central bracket member includes four central bracket member edges; an inner bracket member, wherein the inner bracket member extends from the top side of the base member, wherein the inner bracket member comprises at least two side surfaces, wherein the at least two side surfaces are perpendicular to each other, and wherein the two side surfaces of the inner bracket member intersect at an inner bracket member edge; an outer bracket member, wherein the outer bracket member extends from the top side of the base member, wherein the outer bracket member comprises at least two side surfaces, wherein the at least two side surfaces are perpendicular to each other, wherein the two side surfaces of the outer bracket member intersect at an outer bracket member edge, wherein the two side surfaces intersect at an outer bracket member edge, wherein the central bracket member is positioned substantially between at least a portion of the inner bracket member and the outer bracket member, and wherein the base member edge, two opposing central bracket member edges, the inner bracket member edge, and the outer bracket member edge are aligned.

In various exemplary embodiments, the inner bracket member is positioned such that side walls of the inner bracket member do not extend beyond side surfaces of the central bracket member that extend from a first central bracket member edge and the outer bracket member is positioned such that side walls of the outer bracket member do not extend beyond side surfaces of the central bracket member that extend from a second bracket member edge.

In certain exemplary embodiments, the first terminating surface and the second terminating surface intersect at a peak to form the base member edge. Alternatively, the first terminating surface and the second terminating surface intersect at a valley to form the base member edge.

Accordingly, this invention provides a corner pole bracket system that is designed to be used to lay both wall brick and quoin corners.

This invention separately provides a corner pole bracket system that can be used with corner poles for brickwork.

This invention separately provides a corner pole bracket system that can be used to construct standard walls with no offsets.

This invention separately provides a corner pole bracket system that can be used to construct quoin portions of a wall with an offset.

These and other features and advantages of this invention are described in or are apparent from the following detailed description of the exemplary embodiments.

BRIEF DESCRIPTION OF THE DRAWINGS

The exemplary embodiments of this invention will be described in detail, with reference to the following figures, wherein like reference numerals refer to like parts throughout the several views, and wherein.

DETAILED DESCRIPTION OF EXEMPLARY EMBODIMENTS

Figure 1:
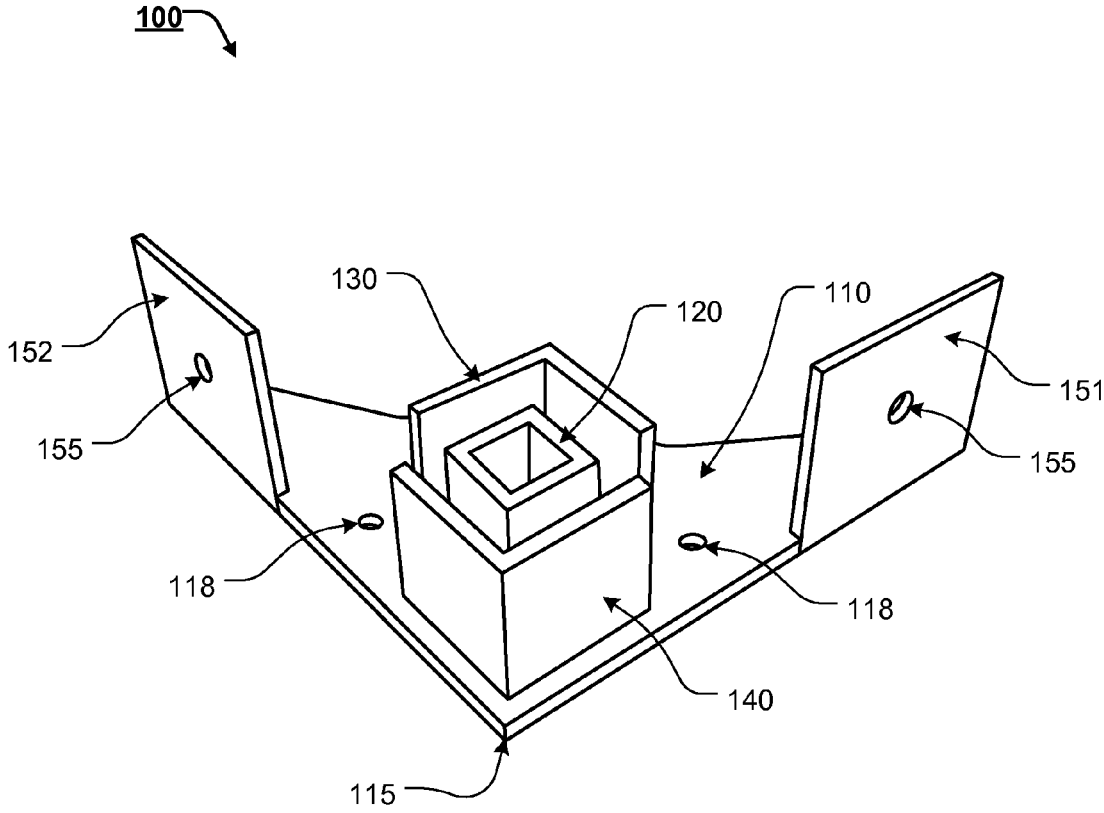
FIG. 1 shows a perspective view of a first exemplary embodiment of an inside corner bracket according to this invention.

For simplicity and clarification, the design factors and operating principles of the corner pole bracket system components of this invention are explained with reference to various exemplary embodiments of the corner pole bracket system components according to this invention. The basic explanation of the design factors and operating principles of the corner pole bracket system components is applicable for the understanding, design, and use of the corner pole bracket system components of this invention.

It should be appreciated that the terms "inside corner bracket", "outside corner bracket", and "wall bracket" are used for basic explanation and understanding of the systems, methods, and/or apparatuses of this invention. Therefore, the terms "inside corner bracket", "outside corner bracket", and "wall bracket" are not to be construed as limiting the systems, methods, and apparatuses of this invention.

It should also be appreciated that while the various exemplary embodiments of the present invention are primarily described and shown as being used to construct brick wall structures they should not be construed as limiting the usage of the present invention. Thus, it should be understood that the corner pole bracket system components of the present invention can be used in the construction of any brick, block, stone, or other wall structure.

It should be understood that the absence of specific detail regarding the techniques used to construct a brick, block, stone, or other wall structure, and/or a quoin corner is intentional as the line block is designed to be utilized with a wide variety and combination of construction techniques and methods.

Turning now to the drawing figures, FIGS. 1-9 show various views of a first exemplary embodiment of an inside corner bracket according to this invention. As illustrated in FIGS. 1-9, the inside corner bracket 100 comprises a base member 110 formed of an elongate portion of material having a top side 111 and a bottom side 112. The base member 110 extends to at least a first terminating surface 113 and a second terminating surface 114.

As illustrated, the first terminating surface 113 is perpendicular to the second terminating surface 114. The first terminating surface 113 intersects the second terminating surface 114 to form an outer base member edge 115. The first terminating surface 113 and the second terminating surface 114 intersect at a peak to form the outer base member edge 115 of the outer base member 110.

In various exemplary embodiments, one or more base attachment apertures 118 are formed through the base member 110. The base attachment apertures 118 are formed so as to allow a screw or other attachment means to pass through each base attachment aperture 118 to optionally secure the inside corner bracket 100 to a floor or other surface.

A first wall attachment portion 151 extends upward, substantially perpendicular to the top side 111 of the base member 110. The first wall attachment portion 151 includes a first wall attachment surface 153 that is aligned with the first terminating surface 113 of the base member 110 so that the first wall attachment surface 153 is coplanar with the first terminating surface 113 of the base member 110.

The first wall attachment portion 151 includes at least one wall attachment aperture 155 formed therethrough, so as to allow a screw or other attachment means to pass through the wall attachment aperture 155 to secure the inside corner bracket 100 to a wall.

Similarly, a second wall attachment portion 152 extends upward, substantially perpendicular to the top side 111 of the base member 110. The second wall attachment portion 152 includes a second wall attachment surface 154 that is aligned with the second terminating surface 114 of the base member 110 so that the second wall attachment surface 154 is coplanar with the second terminating surface 114 of the base member 110.

The second wall attachment portion 152 includes at least one wall attachment aperture 155 formed therethrough, so as to allow a screw or other attachment means to pass through the wall attachment aperture 155 to secure the inside corner bracket 100 to a wall.

The first wall attachment surface 153 of the first wall attachment portion 151 is perpendicular to the second wall attachment surface 154 of the second wall attachment portion 152.

A central bracket member 120 extends from the top side 111 of the base member 110. The central bracket member 120 includes four side walls, each of which has a side surface. In various exemplary embodiments, the central bracket member 120 is in the form of a rectangular prism or a cube and may be solid, hollow, or tubular. Because the central bracket member 120 is a prism, the central bracket member 120 includes four central bracket member edges, at least two of the central bracket member edges, 125 and 127, are opposing central bracket member edges.

The length of each of the sides of the central bracket member 120 is less than an inner length of a corner pole 400 that would be used with the inside corner bracket 100.

An inner bracket member 140 also extends from the top side 111 of the base member 110. In various exemplary embodiments, the inner bracket member 140 is substantially L-shaped, wherein both legs of the L-shaped inner bracket member 140 are of the same length.

The inner bracket member 140 comprises two side walls, each having a side surface. The two side surfaces are perpendicular to each other. These two side surfaces of the inner bracket member 140 intersect to form the inner bracket member edge 145.

An outer bracket member 130 also extends from the top side 111 of the base member 110. In various exemplary embodiments, the outer bracket member 130 is substantially L-shaped, wherein both legs of the L-shaped outer bracket member 130 are of the same length.

The outer bracket member 130 comprises two side walls, each having a side surface. The two side surfaces are perpendicular to each other. These two side surfaces of the outer bracket member 130 intersect to form the outer bracket member edge 135. The length of each of the side surfaces of the outer bracket member 130 is equal to or less than an inner length of a corner pole 400 that would be used with the inside corner bracket 100.

It should be appreciated that the distance that the central bracket member 120, the inner bracket member 140, and/or the outer bracket member 130 extends above the top side 111 of the base member 110 is a design choice.

Figure 2:
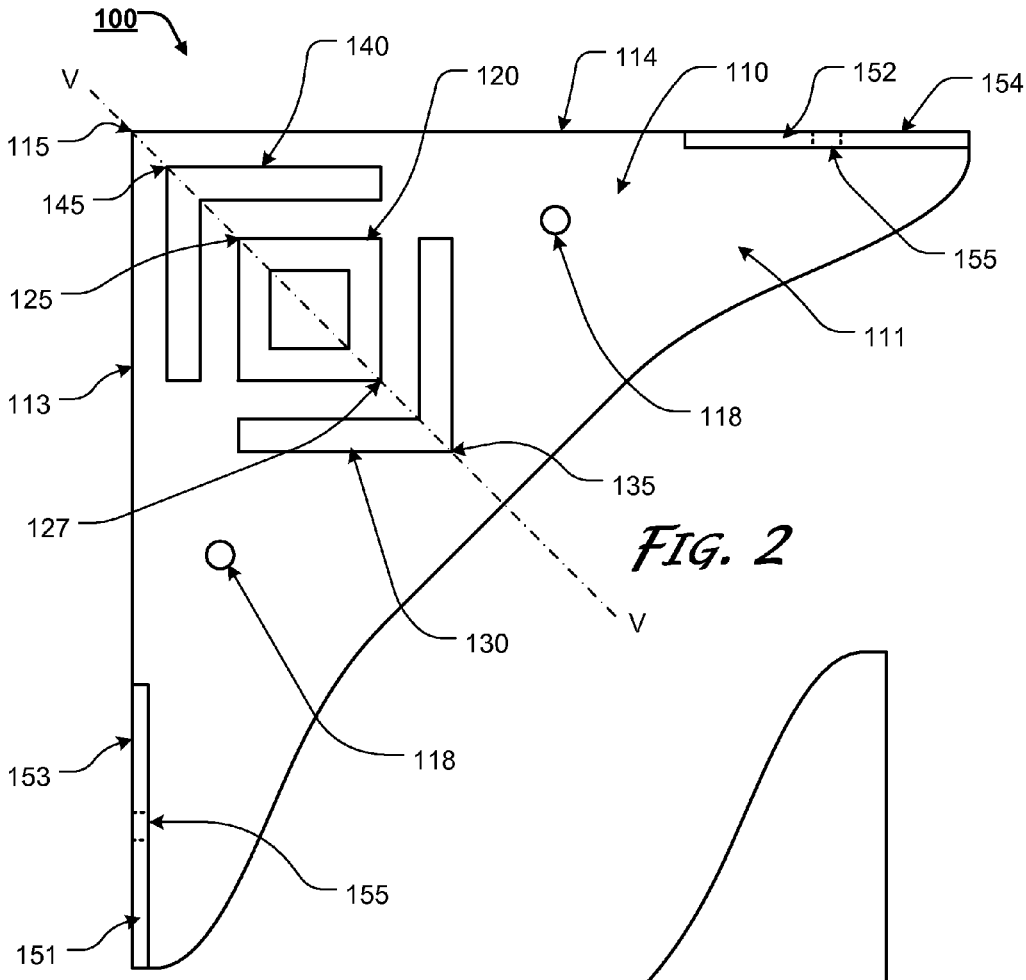
FIG. 2 shows a top view of a first exemplary embodiment of an inside corner bracket according to this invention.
Figure 3:
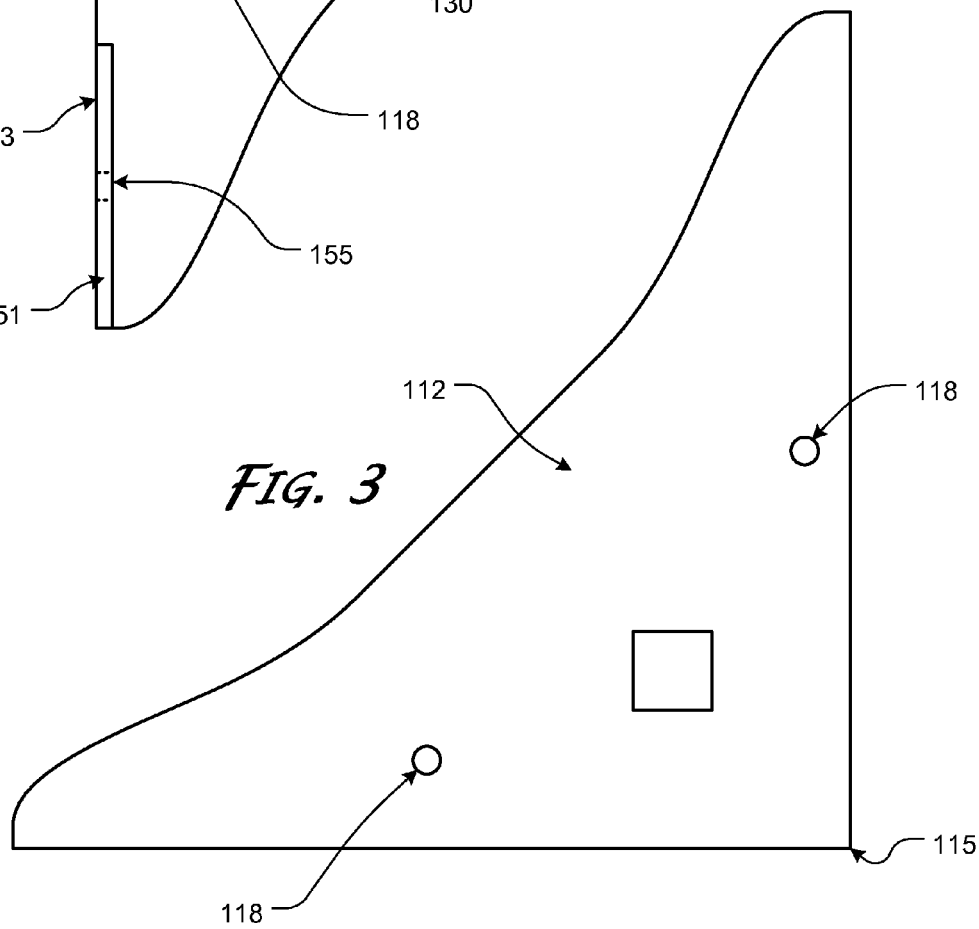
FIG. 3 shows a bottom view of a first exemplary embodiment of an inside corner bracket according to this invention.
Figure 4:
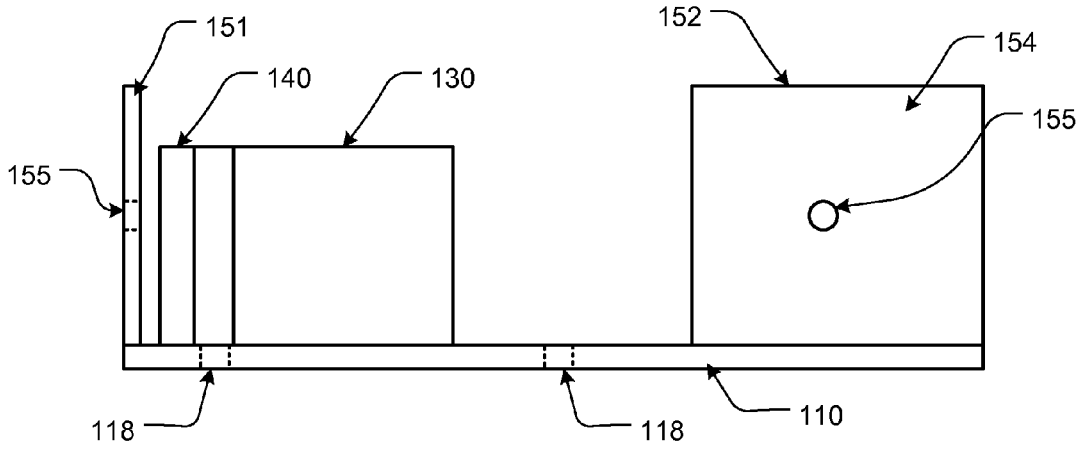
FIG. 4 shows a left side view of a first exemplary embodiment of an inside corner bracket according to this invention.
Figure 5:
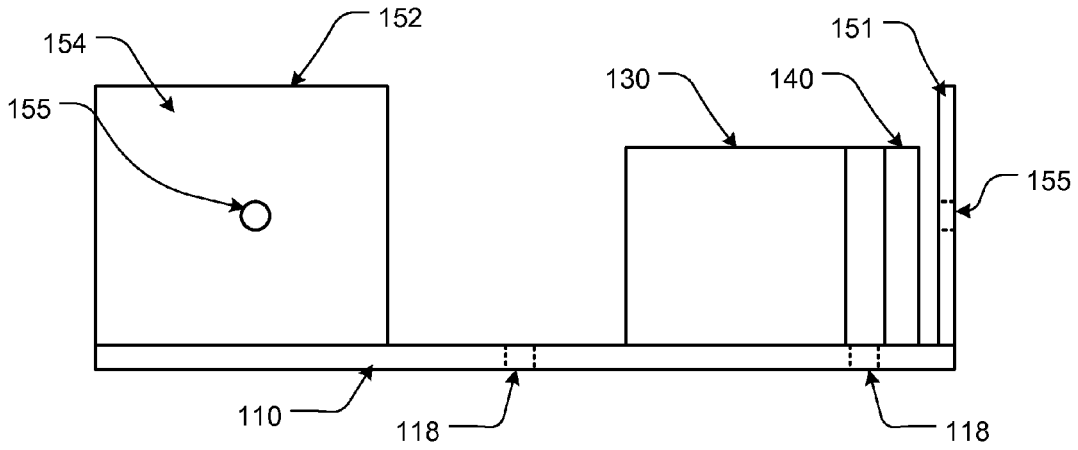
FIG. 5 shows a right side view of a first exemplary embodiment of an inside corner bracket according to this invention.

As shown in FIG. 2, the central bracket member 120 is positioned substantially between at least a portion of the inner bracket member 140 and the outer bracket member 130, such that the outer base member edge 115, the two opposing central bracket member edges 125 and 127, the inner bracket member edge 145, and the outer bracket member edge 135 are aligned along line V-V.

The inner bracket member 140 is positioned such that the side walls of the inner bracket member 140 do not extend beyond the side surfaces of the central bracket member 120 that extend from the central bracket member edge 127. Similarly, the outer bracket member 130 is positioned such that the side walls of the outer bracket member 130 do not extend beyond the side surfaces of the central bracket member 120 that extend from the bracket member edge 125.

Figure 6:
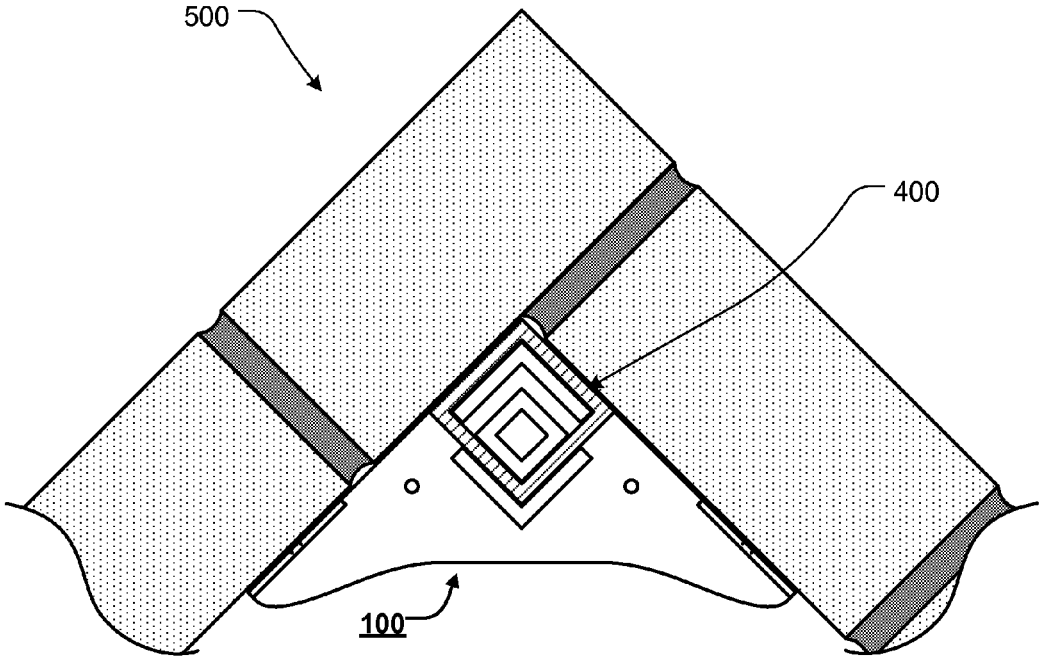
FIG. 6 shows a top view of a first exemplary embodiment of an inside corner bracket, wherein the inside corner bracket is shown in use against an inside wall corner of a brick wall structure with a corner pole in a first position according to this invention.
Figure 7:
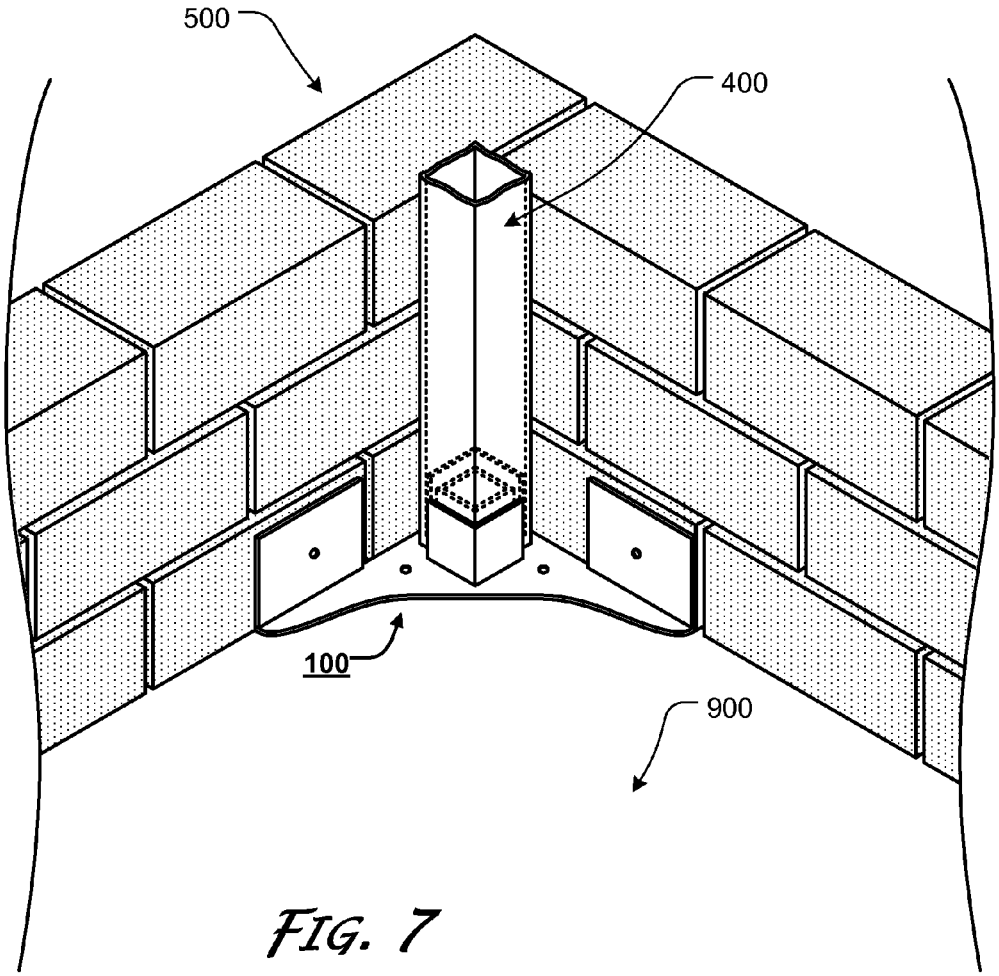
FIG. 7 shows a perspective view of a first exemplary embodiment of an inside corner bracket, wherein the inside corner bracket is shown in use against an inside wall corner of a brick wall structure with a corner pole in a first position according to this invention.
Figure 8:
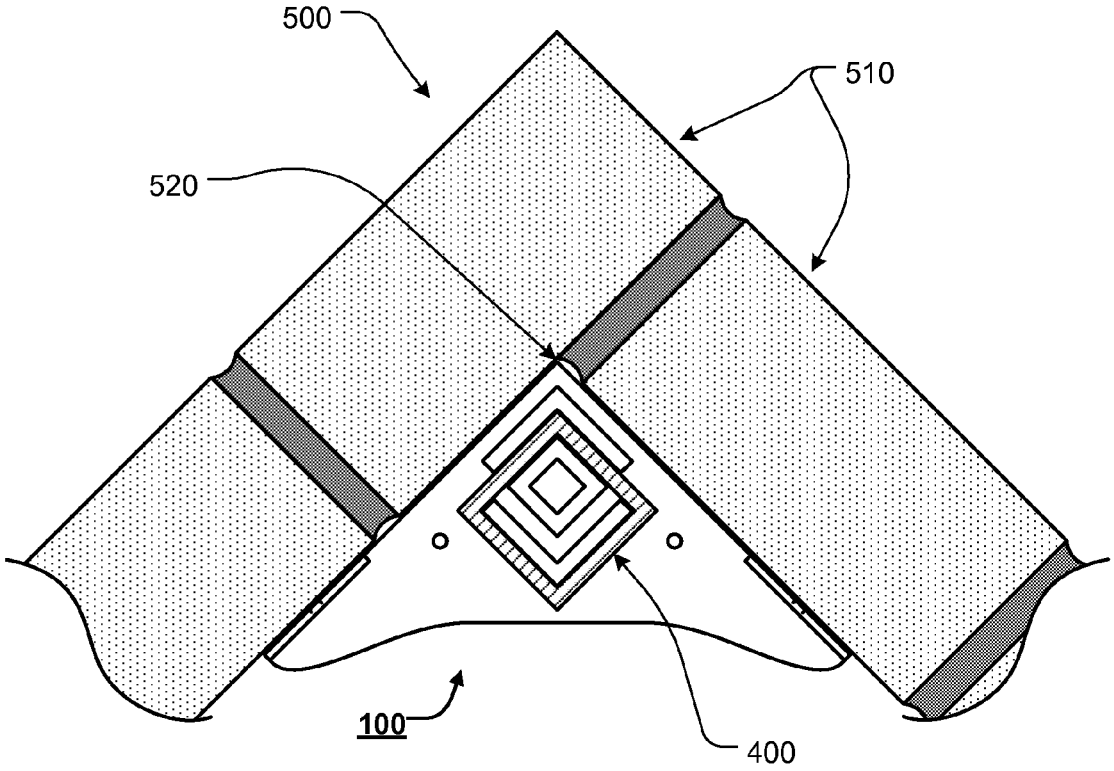
FIG. 8 shows a top view of a first exemplary embodiment of an inside corner bracket, wherein the inside corner bracket is shown in use against an inside wall corner of a brick wall structure with a corner pole in a second position according to this invention.
Figure 9:
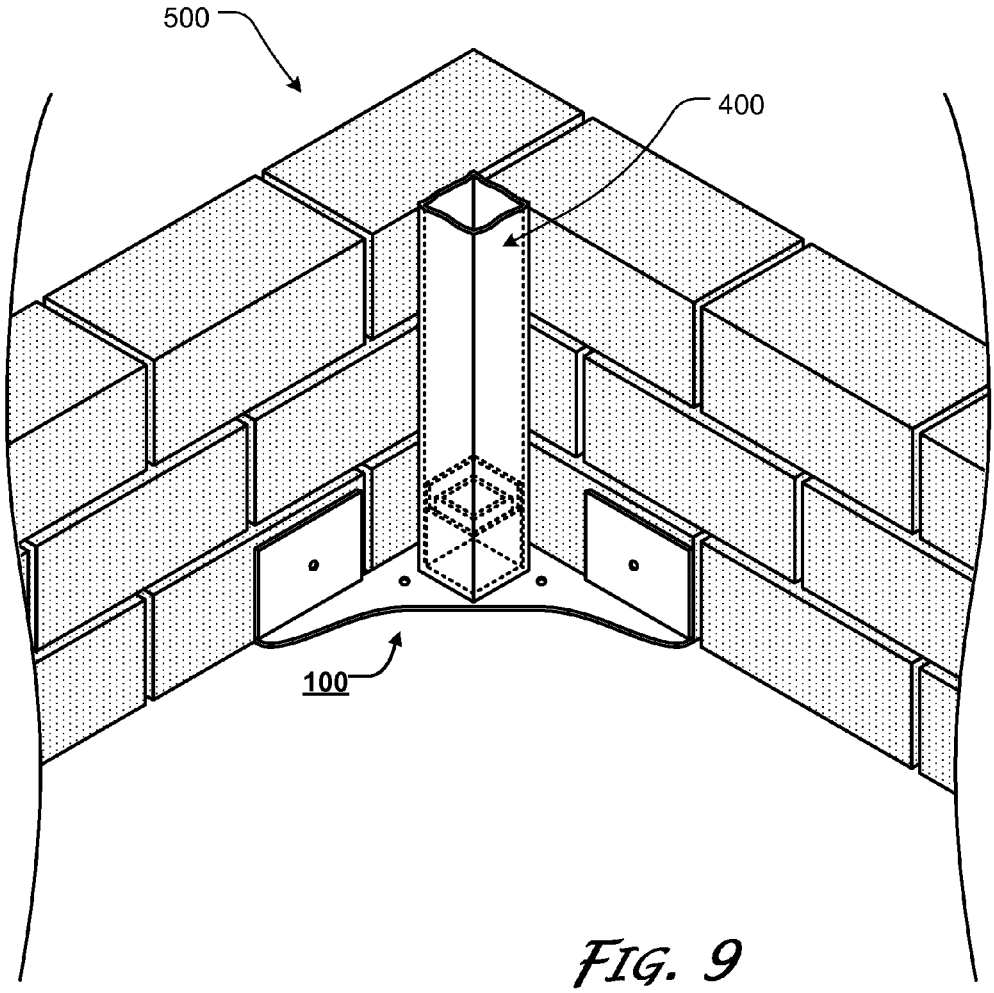
FIG. 9 shows a perspective view of a first exemplary embodiment of an inside corner bracket, wherein the inside corner bracket is shown in use against an inside wall corner of a brick wall structure with a corner pole in a second position according to this invention.
Figure 10:
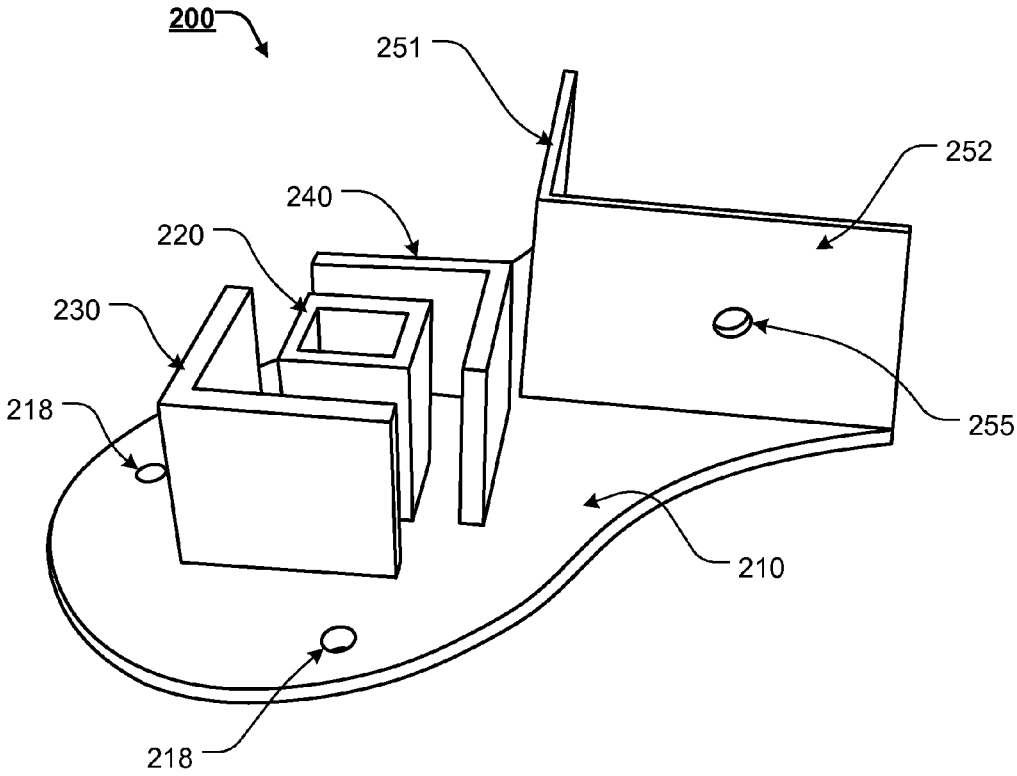
FIG. 10 shows a perspective view of a first exemplary embodiment of an outside corner bracket according to this invention.

Because of the dimensions and alignment of the central bracket member 120, the inner bracket member 140, and the outer bracket member 130, a hollow, tubular corner pole 400 can be aligned with and placed around a combination of the inner bracket member 140 and a central bracket member 120, as illustrated in FIGS. 6 and 7, or a combination of the outer bracket member 130 and the central bracket member 120, as illustrated in FIGS. 8 and 9.

Because of the dimensions and alignment of the outer base member edge 115, the first wall attachment portion 151, and the second wall attachment portion 152, the inside corner bracket 100 can be aligned with and an inner corner 520 of a brick wall 500, as illustrated in FIGS. 6-9. Once aligned with the brick wall 500, the inside corner bracket 100 can optionally be secured to the brick wall 500 by screws or other attachment means being fastened through the attachment wall apertures 155 into the bricks 510 of the brick wall 500.

Once aligned with a brick wall 500, a corner pole 400 can be placed at one of two known distances from the brick wall 500.

It should be understood that the inside corner bracket 100 can be used to initially construct the brick wall 500 atop a foundation 900. If the inside corner bracket 100 is used in the initial construction of a brick wall 500, inside corner bracket 100 is initially affixed in a desired position atop a foundation 900. Once inside corner bracket 100 is affixed atop the foundation 900, the corner pole 400 can be placed atop the inside corner bracket 100, as described herein, and the brick wall 500 can be constructed.

FIGS. 10-18 show various views of a first exemplary embodiment of an outside corner bracket according to this invention. As illustrated in FIGS. 10-18, the outside corner bracket 200 comprises a base member 210 formed of an elongate portion of material having a top side 211 and a bottom side 212. The base member 210 extends to at least a first terminating surface 213 and a second terminating surface 214. As illustrated, the first terminating surface 213 is perpendicular to the second terminating surface 214. The first terminating surface 213 intersects the second terminating surface 214 to form an inner base member edge 215.

While the first terminating surface 113 and the second terminating surface 114 intersect at a peak to form the outer base member edge 115 of the outer base member 110, the first terminating surface 213 and the second terminating surface 214 of the inner base member 210 intersect at a valley to form the inner base member edge 215.

In various exemplary embodiments, one or more base attachment apertures 218 are formed through the base member 210. The base attachment apertures are formed so as to allow a screw or other attachment means to pass through each base attachment aperture 218 to optionally secure the outside corner bracket 200 to a floor or other surface.

A first wall attachment portion 251 extends upward, substantially perpendicular to the top side 211 of the base member 210. The first wall attachment portion 251 includes a first wall attachment surface 253 that is aligned with the first terminating surface 213 of the base member 210 so that the first wall attachment surface 253 is coplanar with the first terminating surface 213 of the base member 210.

The first wall attachment portion 251 includes at least one wall attachment aperture 255 formed therethrough, so as to allow a screw or other attachment means to pass through the wall attachment aperture 255 to secure the outside corner bracket 200 to a wall.

Similarly, a second wall attachment portion 252 extends upward, substantially perpendicular to the top side 211 of the base member 210. The second wall attachment portion 252 includes a second wall attachment surface 254 that is aligned with the second terminating surface 214 of the base member 210 so that the second wall attachment surface 254 is coplanar with the second terminating surface 214 of the base member 210.

The second wall attachment portion 252 includes at least one wall attachment aperture 255 formed therethrough, so as to allow a screw or other attachment means to pass through the wall attachment aperture 255 to secure the outside corner bracket 200 to a wall.

The first wall attachment surface 253 of the first wall attachment portion 251 is perpendicular to the second wall attachment surface 254 of the second wall attachment portion 252.

A central bracket member 220 extends from the top side 211 of the base member 210. The central bracket member 220 includes four side walls, each of which has a side surface. In various exemplary embodiments, the central bracket member 220 is in the form of a rectangular prism or a cube and may be solid, hollow, or tubular. Because the central bracket member 220 is a prism, the central bracket member 220 includes four central bracket member edges, at least two of the central bracket member edges, 225 and 227, are opposing central bracket member edges.

The length of each of the sides of the central bracket member 220 is less than an inner length of a corner pole 400 that would be used with the outside corner bracket 200.

An inner bracket member 240 also extends from the top side 211 of the base member 210. In various exemplary embodiments, the inner bracket member 240 is substantially L-shaped, wherein both legs of the L-shaped inner bracket member 240 are of the same length.

The inner bracket member 240 comprises two side walls, each having a side surface. The two side surfaces are perpendicular to each other. These two side surfaces of the inner bracket member 240 intersect to form the inner bracket member edge 245.

An outer bracket member 230 also extends from the top side 211 of the base member 210. In various exemplary embodiments, the outer bracket member 230 is substantially L-shaped, wherein both legs of the L-shaped outer bracket member 230 are of the same length.

The outer bracket member 230 comprises two side walls, each having a side surface. The two side surfaces are perpendicular to each other. These two side surfaces of the outer bracket member 230 intersect to form the outer bracket member edge 235. The length of each of the side surfaces of the outer bracket member 230 is equal to or less than an inner length of a corner pole 400 that would be used with the outside corner bracket 200.

It should be appreciated that the distance that the central bracket member 220, the inner bracket member 240, and/or the outer bracket member 230 extends above the top side 211 of the base member 210 is a design choice.

Figure 11:
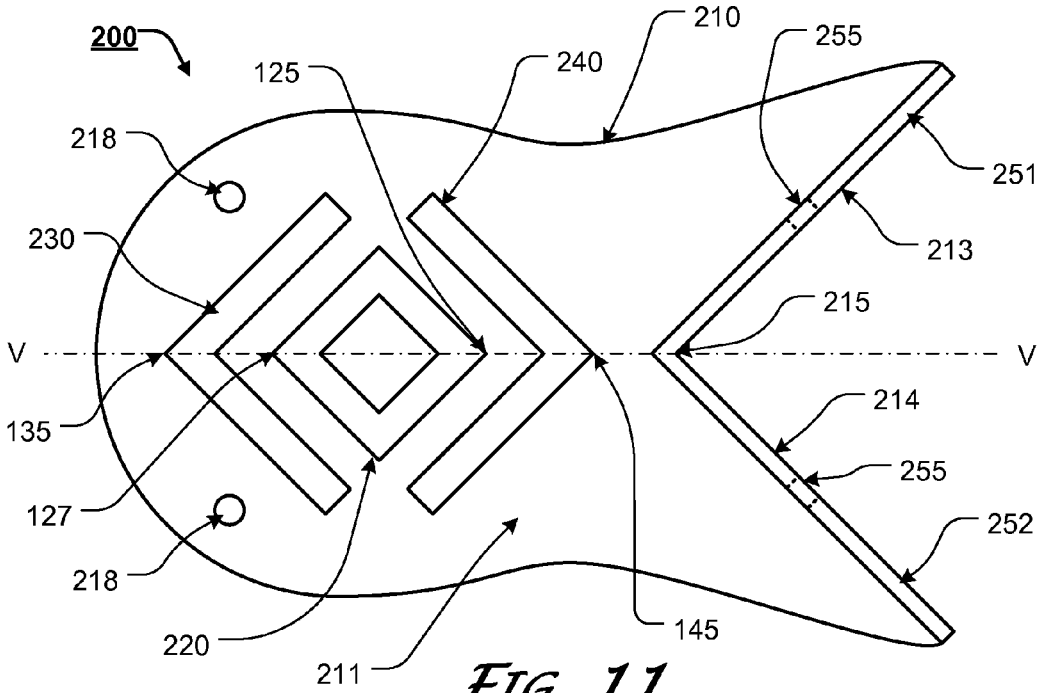
FIG. 11 shows a top view of a first exemplary embodiment of an outside corner bracket according to this invention.
Figure 12:
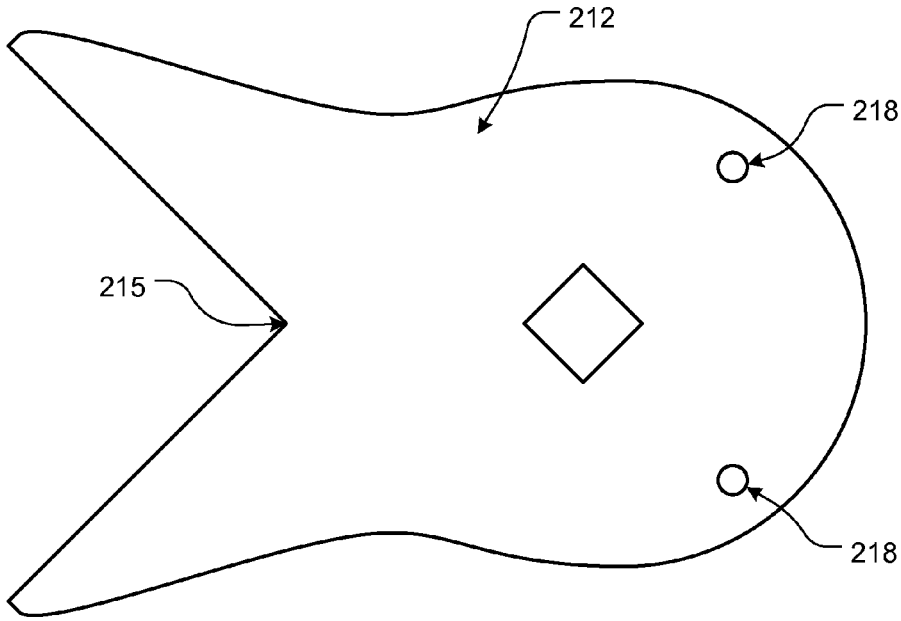
FIG. 12 shows a bottom view of a first exemplary embodiment of an outside corner bracket according to this invention.
Figure 13:
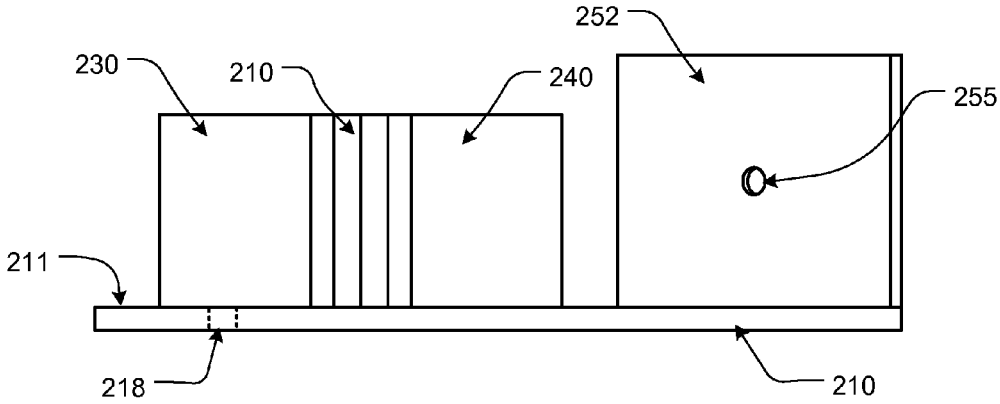
FIG. 13 shows a left side view of a first exemplary embodiment of an outside corner bracket according to this invention.
Figure 14:
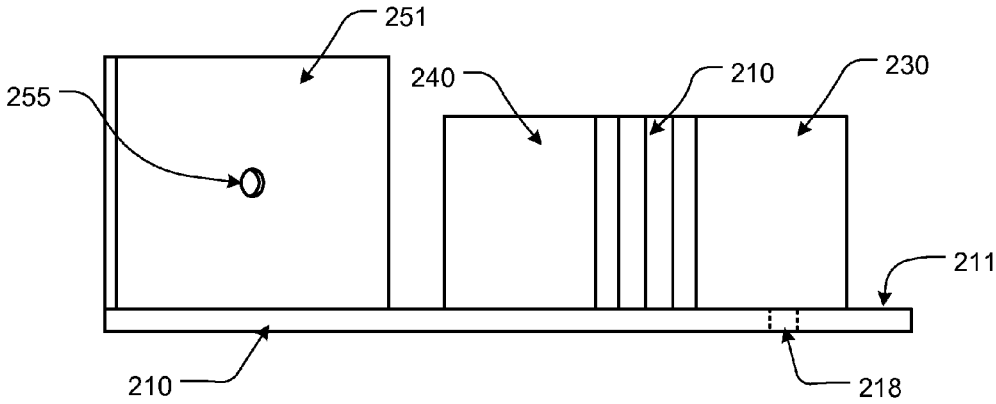
FIG. 14 shows a right side view of a first exemplary embodiment of an outside corner bracket according to this invention.

As shown in FIG. 11, the central bracket member 220 is positioned substantially between at least a portion of the inner bracket member 240 and the outer bracket member 230, such that the inner base member edge 215, the two opposing central bracket member edges 225 and 227, the inner bracket member edge 245, and the outer bracket member edge 235 are aligned along line V-V.

The inner bracket member 240 is positioned such that the side walls of the inner bracket member 240 do not extend beyond the side surfaces of the central bracket member 220 that extend from the central bracket member edge 227. Similarly, the outer bracket member 230 is positioned such that the side walls of the outer bracket member 230 do not extend beyond the side surfaces of the central bracket member 220 that extend from the bracket member edge 225.

Figure 15:
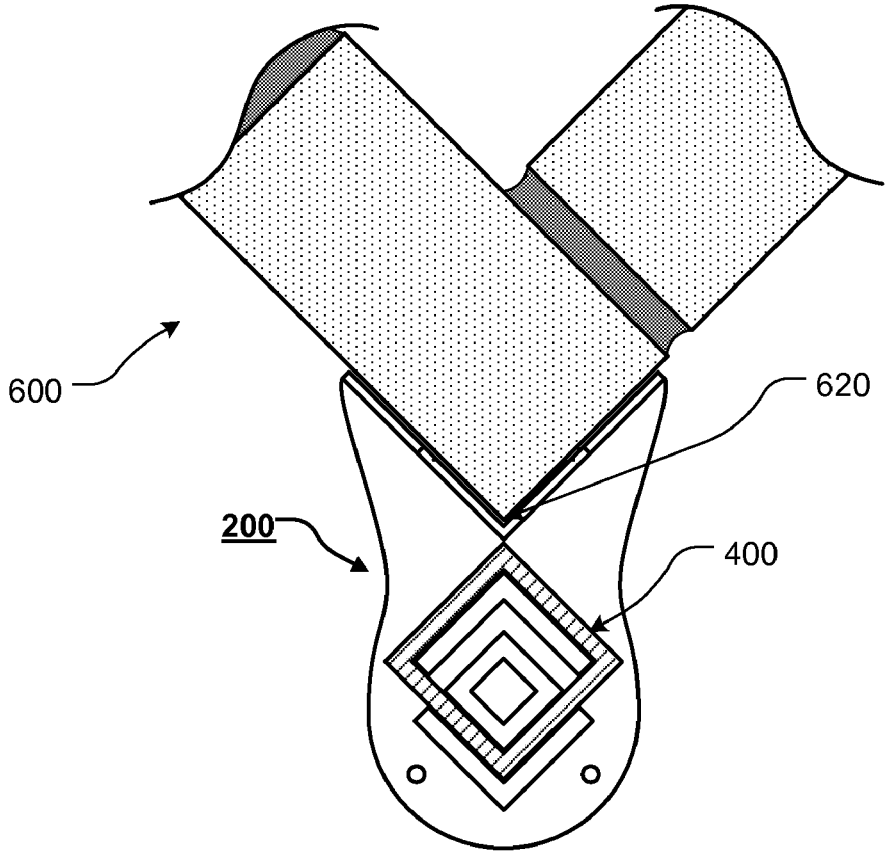
FIG. 15 shows a top view of a first exemplary embodiment of an outside corner bracket, wherein the outside corner bracket is shown in use against an outside wall corner of a brick wall structure with a corner pole in a first position according to this invention.
Figure 16:
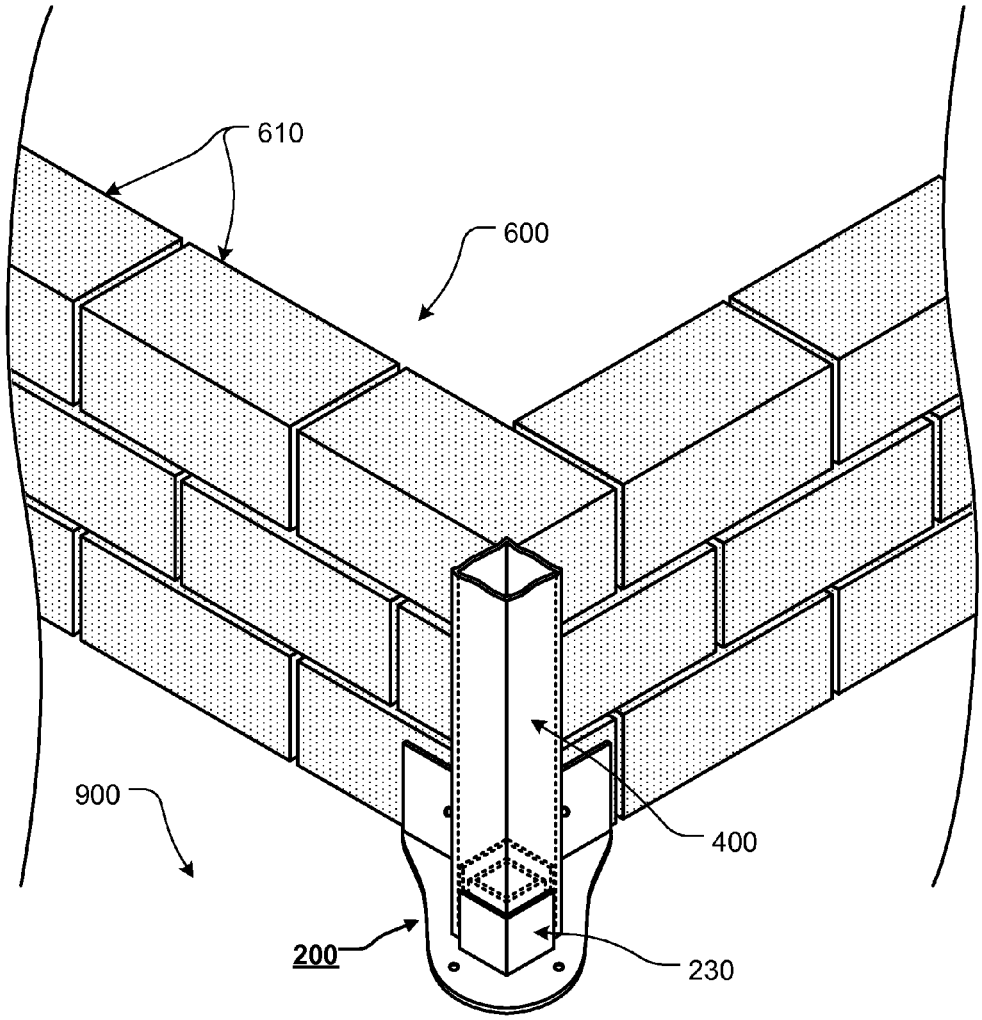
FIG. 16 shows a perspective view of a first exemplary embodiment of an outside corner bracket, wherein the outside corner bracket is shown in use against an outside wall corner of a brick wall structure with a corner pole in a first position according to this invention.
Figure 17:
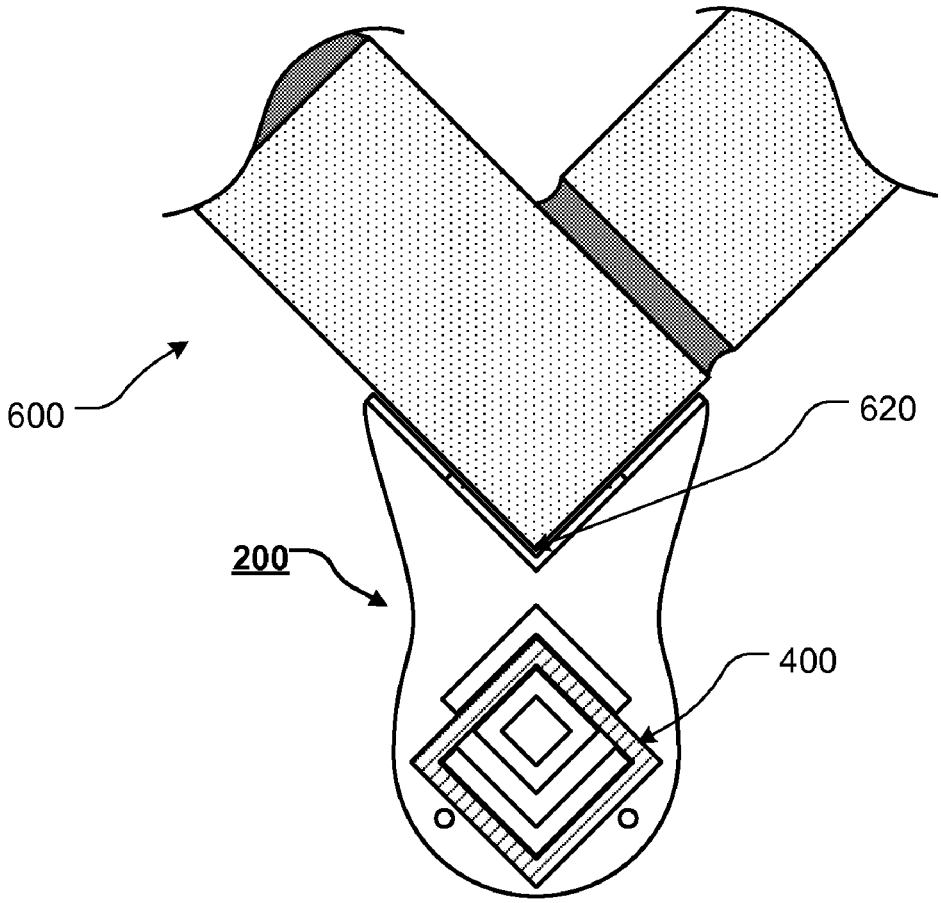
FIG. 17 shows a top view of a first exemplary embodiment of an outside corner bracket, wherein the outside corner bracket is shown in use against an outside wall corner of a brick wall structure with a corner pole in a second position according to this invention.
Figure 18:
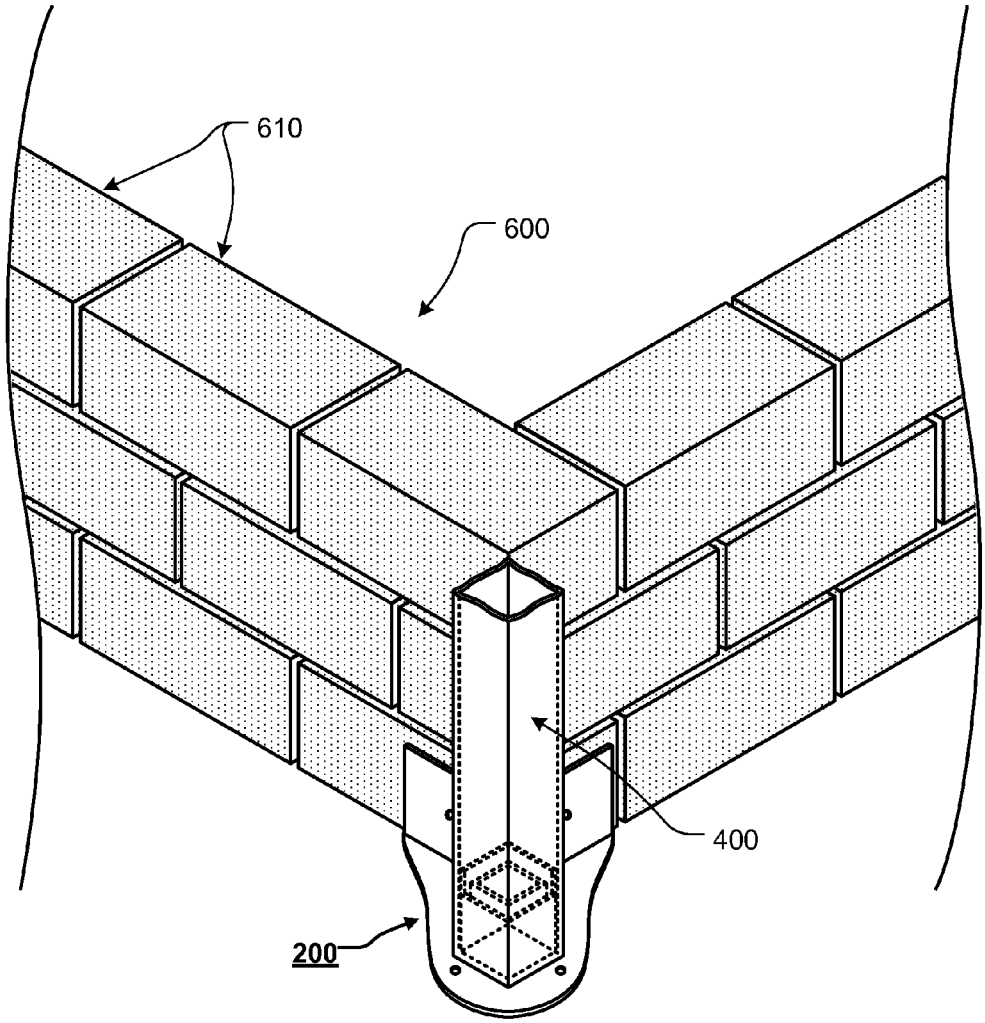
FIG. 18 shows a perspective view of a first exemplary embodiment of an outside corner bracket, wherein the outside corner bracket is shown in use against an outside wall corner of a brick wall structure with a corner pole in a second position according to this invention.
Figure 19:
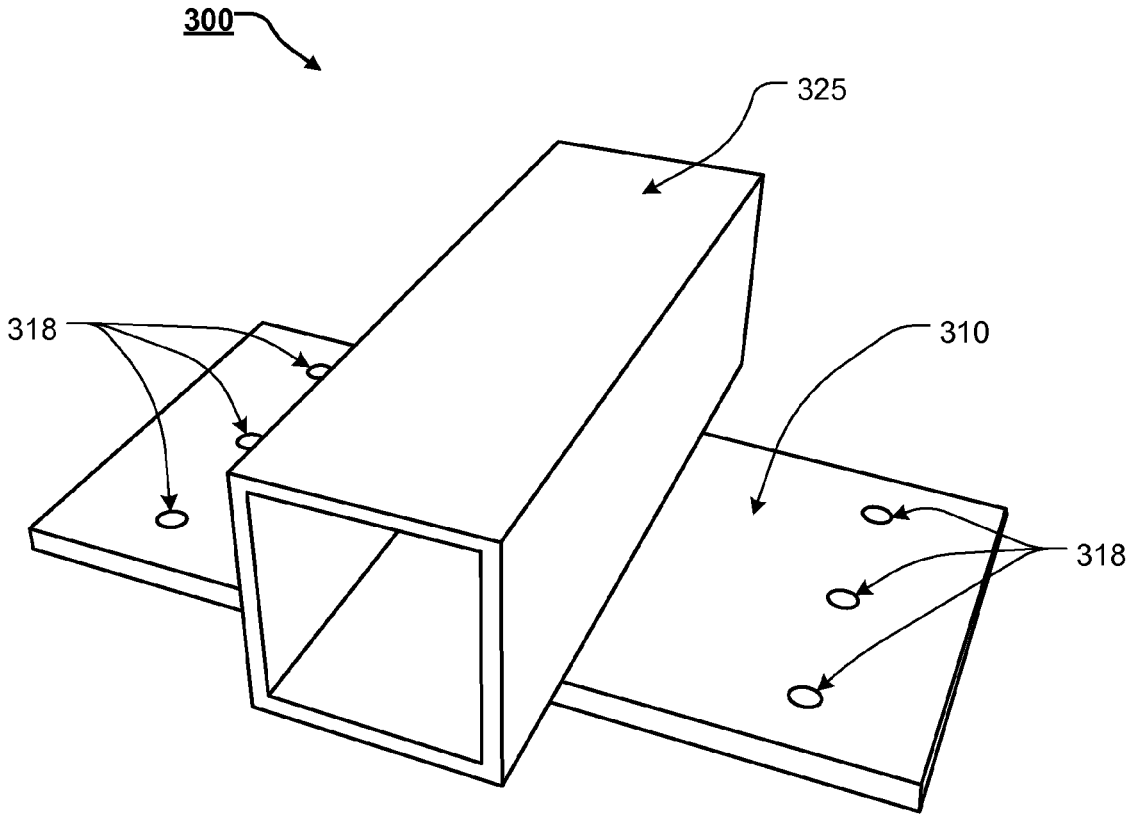
FIG. 19 shows a perspective view of a first exemplary embodiment of a wall bracket according to this invention.
Figure 20:
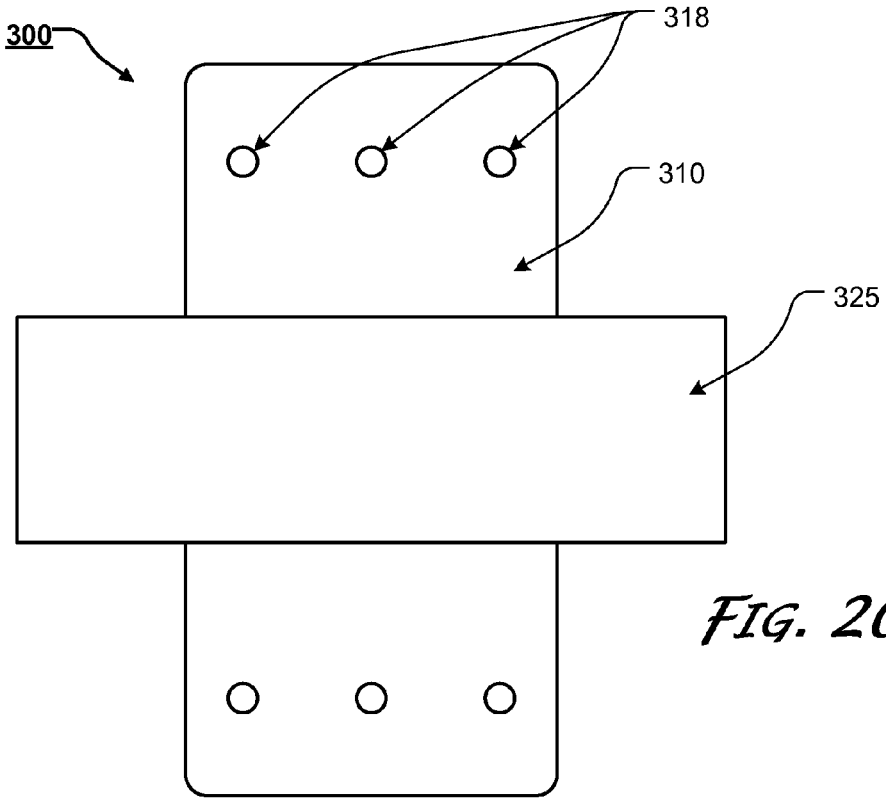
FIG. 20 shows a front view of a first exemplary embodiment of a wall bracket according to this invention.
Figure 21:
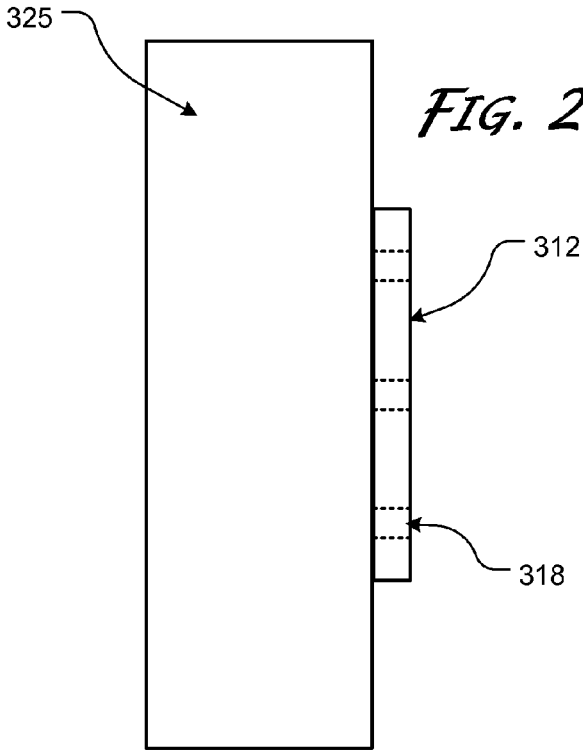
FIG. 21 shows a left side view of a first exemplary embodiment of a wall bracket according to this invention.
Figure 22:
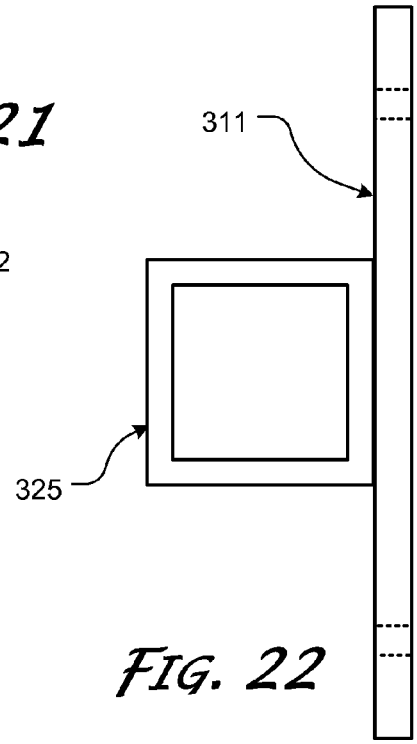
FIG. 22 shows a top view of a first exemplary embodiment of a wall bracket according to this invention.

Because of the dimensions and alignment of the central bracket member 220, the inner bracket member 240, and the outer bracket member 230, a hollow, tubular corner pole 400 can be aligned with and placed around a combination of the inner bracket member 240 and a central bracket member 220, as illustrated in FIGS. 15 and 16, or a combination of the outer bracket member 230 and the central bracket member 220, as illustrated in FIGS. 17 and 18.

Because of the dimensions and alignment of the inner base member edge 215, the first wall attachment portion 251, and the second wall attachment portion 252, the outside corner bracket 200 can be aligned with and an inner corner 620 of a brick wall 600, as illustrated in FIGS. 15-18. Once aligned with the brick wall 600, the outside corner bracket to optionally be secured to the brick wall 600 by screws or other attachment means being fastened through the attachment wall apertures 255 into the bricks 610 of the brick wall 600.

Once aligned with a brick wall 600, a corner pole 400 can be placed at one of two known distances from the brick wall 600.

It should be understood that the outside corner bracket 200 can be used to initially construct the brick wall 600 atop a foundation 900. If the outside corner bracket 200 is used in the initial construction of a brick wall 600, outside corner bracket 200 is initially affixed in a desired position atop a foundation 900. Once outside corner bracket 200 is affixed atop the foundation 900, the corner pole 400 can be placed atop the outside corner bracket 200, as described herein, and the brick wall 600 can be constructed.

It should also be understood that if the foundation 900 does not extend far enough to allow the outside corner bracket 200 to be affixed atop the foundation 900, the outside corner bracket 200 may be affixed to a temporary surface that is substantially coplanar with the foundation 900 or an initial number of bricks 610 can be laid to create a corner that the outside corner bracket 200 can be affixed to.

FIGS. 19-23 show a first exemplary embodiment of a wall bracket according to this invention. As illustrated in FIGS. 19-23, the wall bracket 300 comprises at least some of a bracket member 325 attached to a base member 310. The bracket member 325 extends beyond at least two sides of the base member 310.

In various exemplary embodiments, one or more base attachment apertures 318 are formed through the base member 310. The base attachment apertures 318 are formed so as to allow a screw or other attachment means to pass through each base attachment aperture 318 to optionally secure the base member 310 to a wall or other surface.

Figure 23:
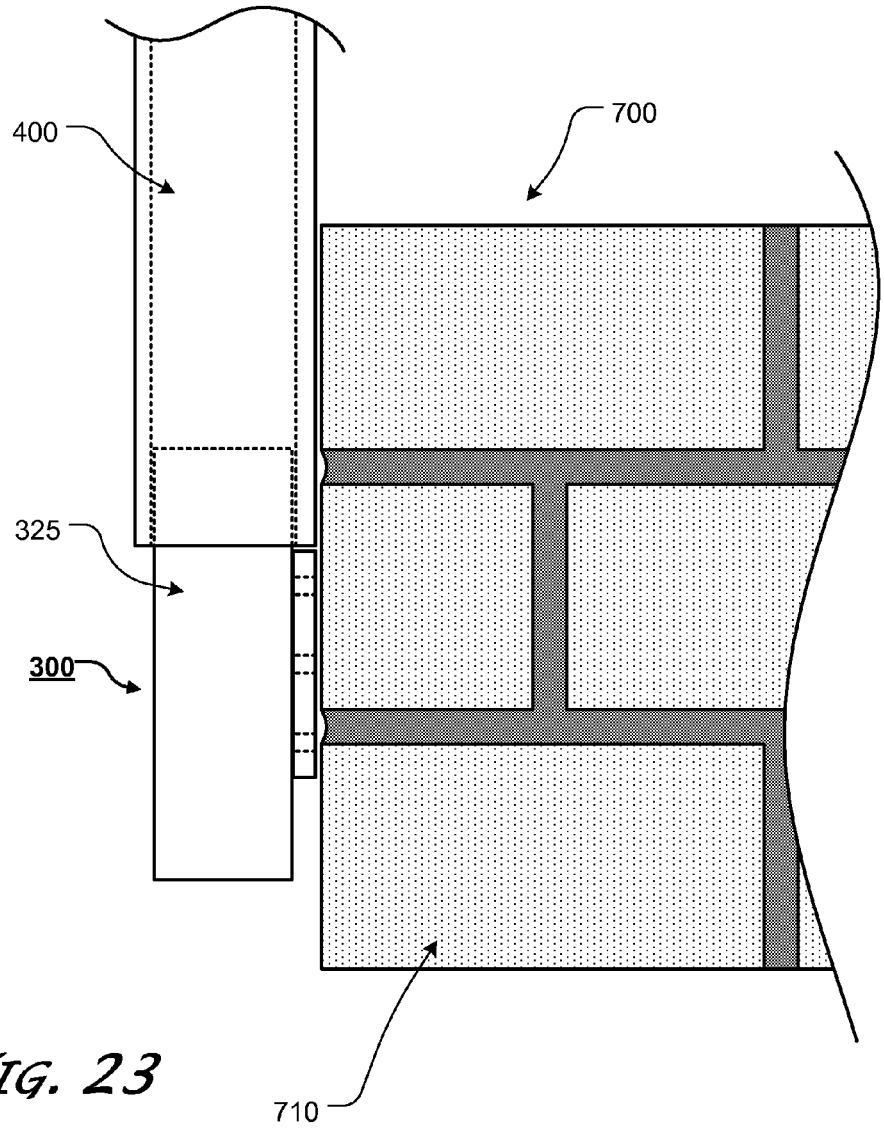
FIG. 23 shows a left side view of a first exemplary embodiment of a wall bracket wherein the wall bracket is shown in use against a brick wall structure with a corner pole attached to the wall bracket according to this invention.

As shown in FIG. 23, the base member 310 can be attached or coupled to a wall or other surface, such as, for example, brick wall 700 comprised of bricks 710. Once the wall bracket 300 is attached or coupled to the brick wall, the bracket member 325 can be placed within a corner pole 400, so that the corner pole 400 can be maintained at a known distance from the brick wall 700.

FIGS. 24-27 show a first exemplary embodiment of an outside corner bracket 200 attached to a brick wall 600, comprised of bricks 610. Once the outside corner bracket 200 is attached to the brick wall 600, a corner pole 400 can be aligned with and placed around a combination of the inner bracket member 240 and a central bracket member 220, as illustrated in FIGS. 15 and 16, or a combination of the outer bracket member 230 and the central bracket member 220, as illustrated in FIGS. 17 and 18. While FIGS. 24-27 show the corner pole 400 aligned and placed around a combination of the outer bracket member 230 and the central bracket member 220, it should be appreciated that the corner pole 400 can be placed at one of two known distances from the brick wall 600.

Once the corner pole 400 is positioned atop the corner bracket 200, a line block 800, such as, for example, the line block disclosed in U.S. Pat. No. 7,673,393 (the entire disclosure of which is incorporated herein by reference), can be positioned along the corner pole 400.

Figure 24:
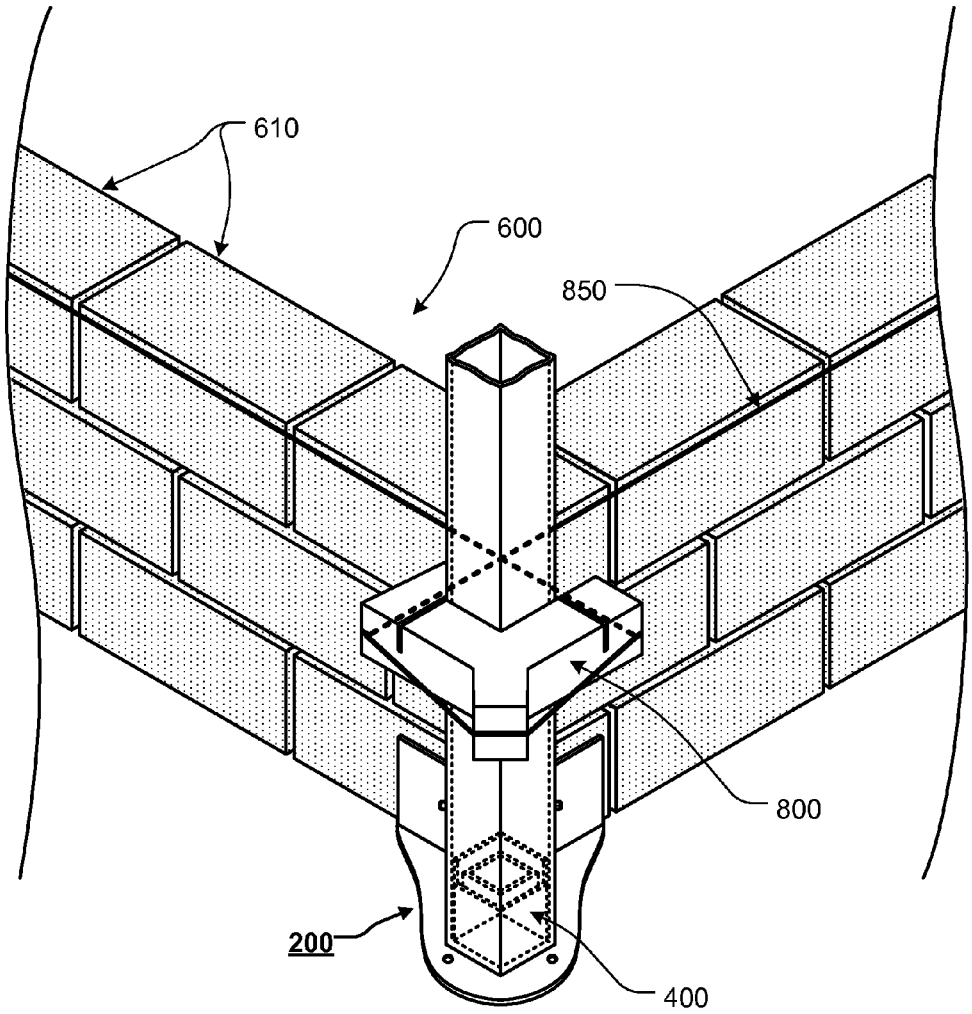
FIG. 24 shows a perspective view of a first exemplary embodiment of an outside corner bracket, wherein the outside corner bracket is shown in use against an outside wall corner of a brick wall structure with a corner pole in a second position, and wherein a line block is positioned for construction of a wall portion of a brick wall structure according to this invention.
Figure 25:
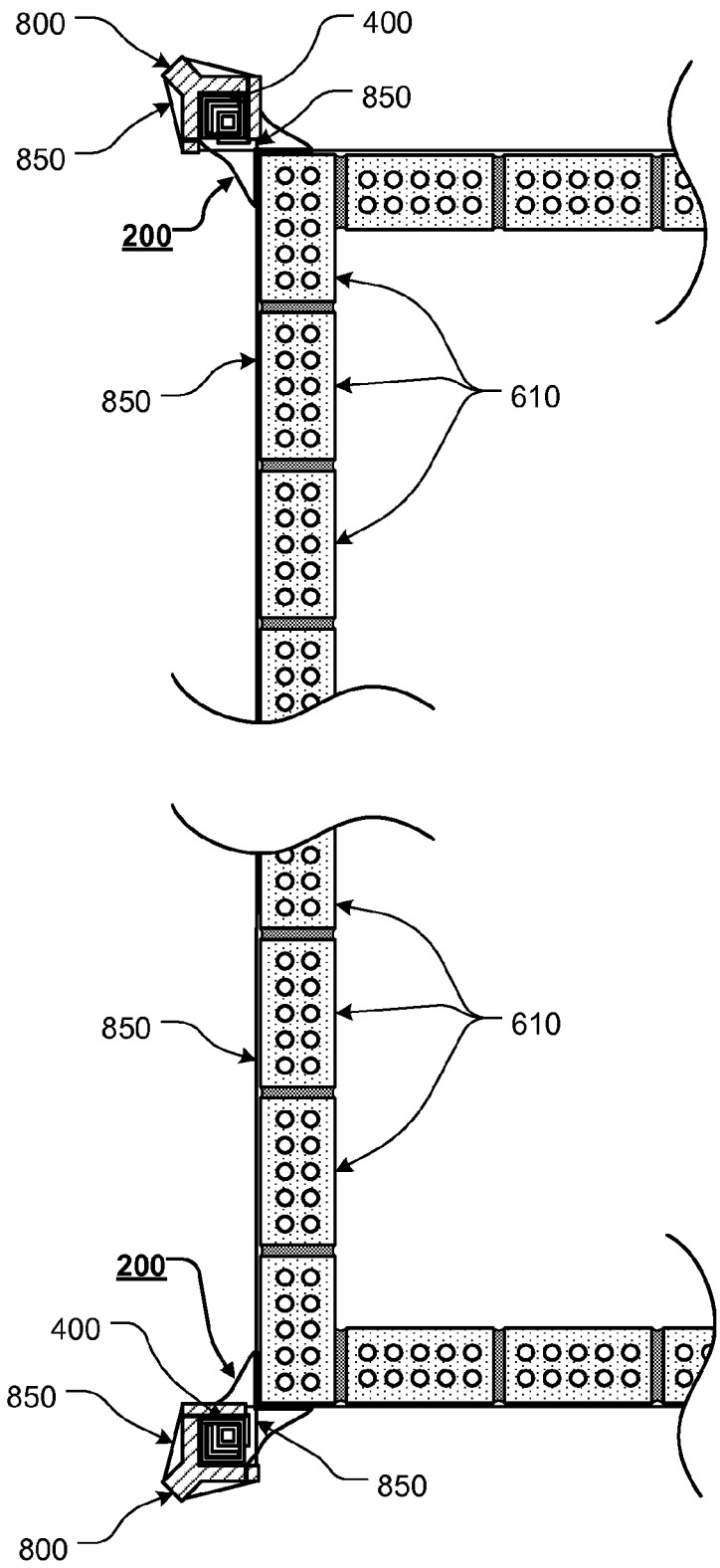
FIG. 25 shows a top view of the first exemplary embodiment of the outside corner bracket according to this invention, wherein an outside corner bracket is positioned at opposite corners of a brick wall structure such that two line blocks are positioned for construction of a wall portion of a brick wall structure.

As illustrated in FIG. 24, the line block 800 may be positioned along the corner pole 400 for construction of a portion of the brick wall 600. As shown in FIG. 25, a separate outside corner bracket 200 can be positioned at opposite corners of a brick wall 600 such that two line blocks 800 are positioned for construction of the wall portion of the brick wall 600. During construction, line 850 can be used as a reference for placement of additional bricks 610.

Figure 26:
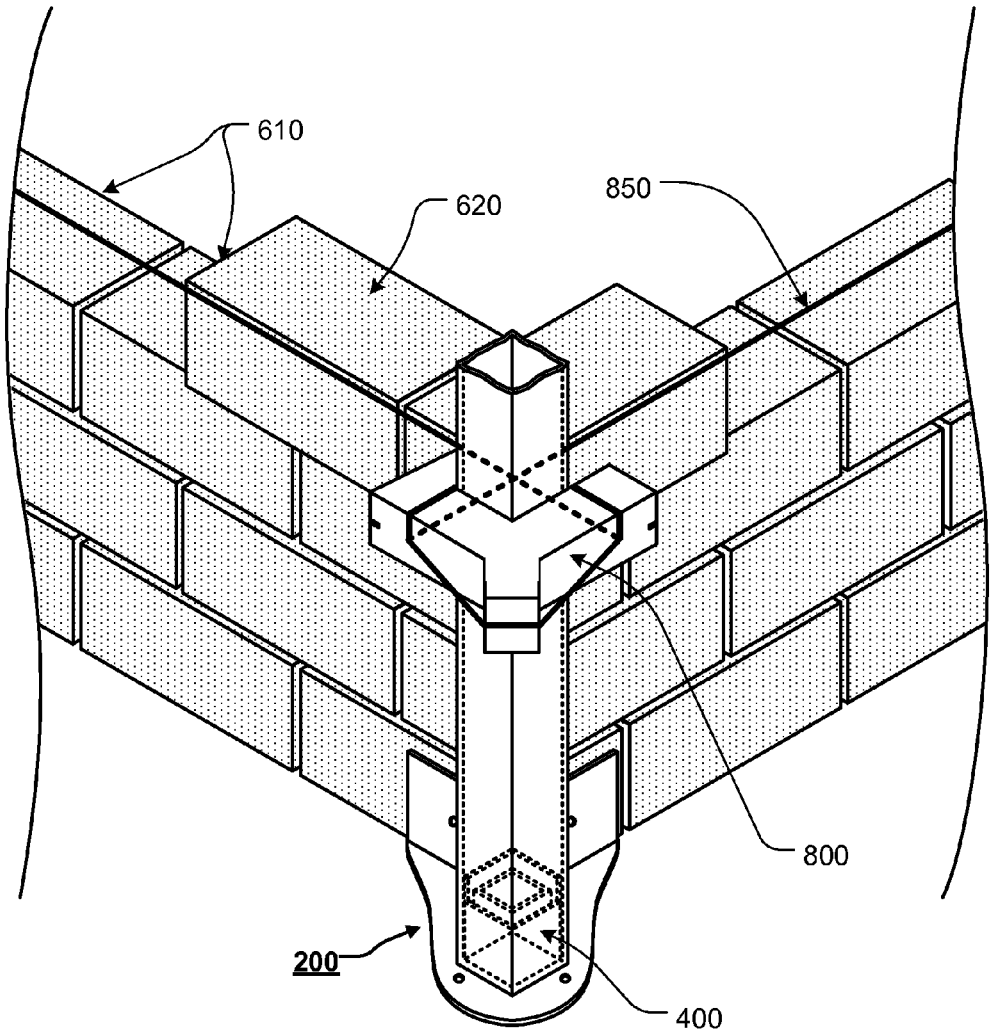
FIG. 26 shows a perspective view of a first exemplary embodiment of an outside corner bracket, wherein the outside corner bracket is shown in use against an outside wall corner of a brick wall structure with a corner pole in a second position, and wherein a line block is positioned for construction of a quoin corner portion of the brick wall structure according to this invention.
Figure 27:
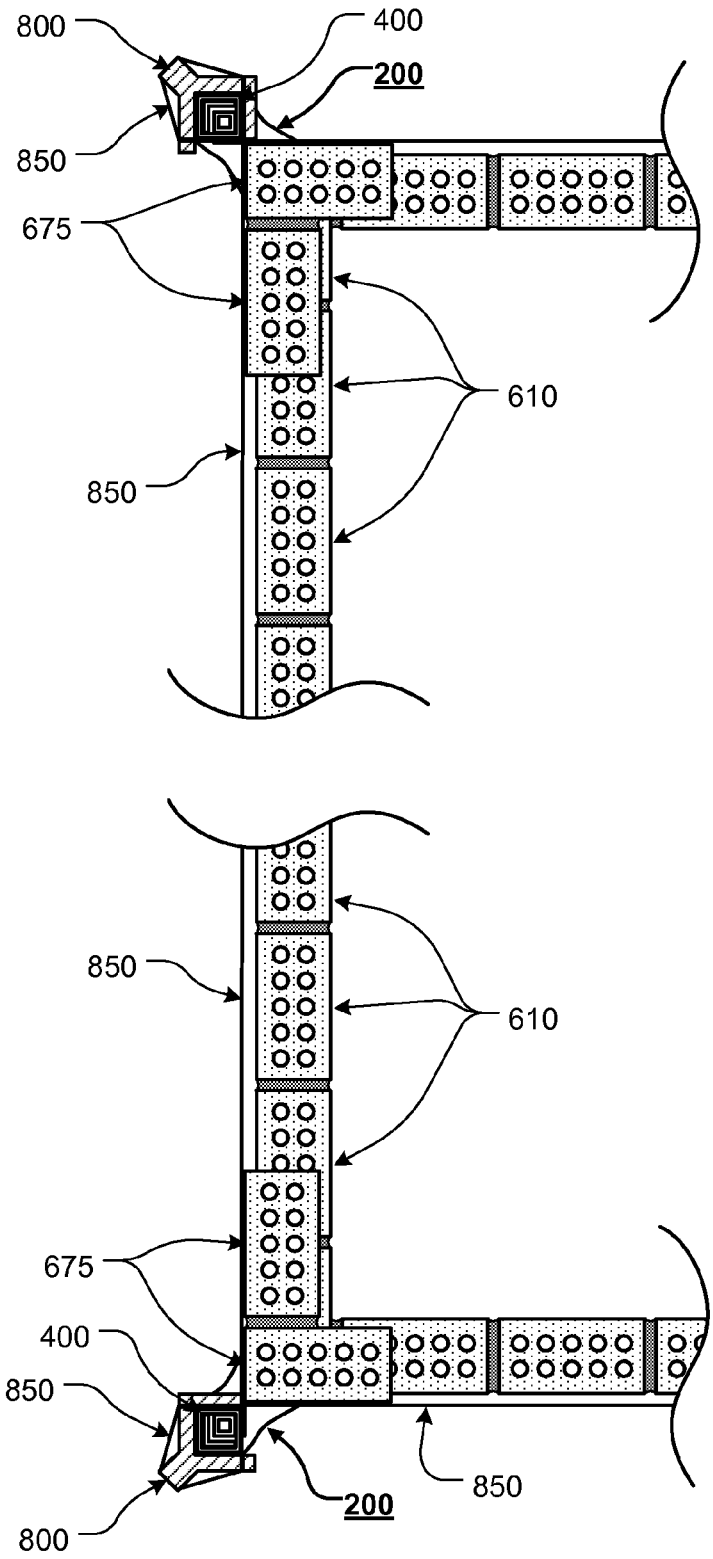
FIG. 27 shows a top view of the first exemplary embodiment of the outside corner bracket according to this invention, wherein an outside corner bracket is positioned at opposite corners of a brick wall structure such that two line blocks are positioned for construction of a quoin corner portion of the brick wall structure.

As illustrated in FIG. 26, the line block 800 may be positioned along the corner pole 400 for construction of a quoin corner portion of the brick wall 600. As shown in FIG. 27, a separate outside corner bracket 200 can be positioned at opposite corners of a brick wall 600 such that two line blocks 800 are positioned for construction of the quoin corner portion of the brick wall 600. During construction, line 850 can be used as a reference for placement of additional bricks 610 to form the quoin corner portion of the wall 600.

It should be understood that as the wall 600 or the quoin portion of the wall 600 is built, the line blocks 800 may be moved upward along the corner poles 400 and the line 850 can again be easily moved from the quoin line grooves to the wall line grooves, so that the standard wall portions and/or the quoin portion of the wall 600 can be constructed.

While this invention has been described in conjunction with the exemplary embodiments outlined above, it is evident that many alternatives, modifications, and variations will be apparent to those skilled in the art. Any and all such adaptations, modifications, and variations should and are intended to be comprehended within the meaning and range of equivalents of the disclosed exemplary embodiments.

It is to be understood that the phraseology of terminology employed herein is for the purpose of description and not of limitation. Accordingly, the foregoing description of the exemplary embodiments of the invention, as set forth above, are intended to be illustrative, not limiting. Various changes, modifications, and/or adaptations may be made without departing from the spirit and scope of this invention.

What is claimed is:

1. A corner bracket, comprising:

a base member comprising an elongate portion of material having a top side and a bottom side, wherein said base member extends to at least a first terminating surface and a second terminating surface, wherein said first terminating surface is perpendicular to said second terminating surface, and wherein said first terminating surface intersects said second terminating surface at a base member edge;

a first wall attachment portion extending substantially perpendicular to said top side of said base member, wherein said first wall attachment portion includes a first wall attachment surface, wherein said first wall attachment surface of said first wall attachment portion is coplanar with said first terminating surface of said base member, and wherein at least one wall attachment aperture is formed through said first wall attachment portion;

a second wall attachment portion extending substantially perpendicular to said top side of said base member, wherein said second wall attachment portion includes a second wall attachment surface, wherein said second wall attachment surface of said second wall attachment portion is coplanar with said second terminating surface of said base member, wherein at least one wall attachment aperture is formed through said second wall attachment portion, and wherein said first wall attachment surface of said first wall attachment portion is perpendicular to said second wall attachment surface of said second wall attachment portion;

a central bracket member, wherein said central bracket member extends from said top side of said base member, wherein said central bracket member is in the form of a rectangular prism, and wherein said central bracket member includes four central bracket member edges;

an inner bracket member, wherein said inner bracket member extends from said top side of said base member, wherein said inner bracket member comprises at least two side surfaces, wherein said at least two side surfaces are perpendicular to each other, and wherein said two side surfaces of said inner bracket member intersect at an inner bracket member edge; and an outer bracket member, wherein said outer bracket member extends from said top side of said base member, wherein said outer bracket member comprises at least two side surfaces, wherein said at least two side surfaces are perpendicular to each other, wherein said two side surfaces of said outer bracket member intersect at an outer bracket member edge, wherein said two side surfaces intersect at an outer bracket member edge, wherein said central bracket member is positioned substantially between at least a portion of said inner bracket member and said outer bracket member, and wherein said base member edge, two opposing central bracket member edges, said inner bracket member edge, and said outer bracket member edge are aligned;

wherein said inner bracket member is positioned such that side walls of said inner bracket member do not extend beyond side surfaces of said central bracket member that extend from a first central bracket member edge and said outer bracket member is positioned such that side walls of said outer bracket member do not extend beyond side surfaces of said central bracket member that extend from a second bracket member edge.

2. The corner bracket of claim 1, further comprising at least one base attachment aperture formed through said base member.

3. The corner bracket of claim 1, wherein said central bracket member is in the form of a cube.

4. The corner bracket of claim 1, wherein said inner bracket member and said outer bracket member are substantially L-shaped.

5. The corner bracket of claim 1, wherein legs of said inner bracket member and said outer bracket member are of the same length.

6. An outside corner bracket, comprising:

a base member comprising an elongate portion of material having a top side and a bottom side, wherein said base member extends to at least a first terminating surface and a second terminating surface, wherein said first terminating surface is perpendicular to said second terminating surface, wherein said first terminating surface intersects said second terminating surface at an inner base member edge, and wherein said first terminating surface and said second terminating surface extend from said inner base member edge;

a first wall attachment portion extending substantially perpendicular to said top side of said base member, wherein said first wall attachment portion includes a first wall attachment surface, wherein said first wall attachment surface of said first wall attachment portion is coplanar with said first terminating surface of said base member, and wherein at least one wall attachment aperture is formed through said first wall attachment portion;

a second wall attachment portion extending substantially perpendicular to said top side of said base member, wherein said second wall attachment portion includes a second wall attachment surface, wherein said second wall attachment surface of said second wall attachment portion is coplanar with said second terminating surface of said base member, wherein at least one wall attachment aperture is formed through said second wall attachment portion, and wherein said first wall attachment surface of said first wall attachment portion is perpendicular to said second wall attachment surface of said second wall attachment portion;

a central bracket member, wherein said central bracket member extends from said top side of said base member, wherein said central bracket member is in the form of a rectangular prism, and wherein said central bracket member includes four central bracket member edges;

an inner bracket member, wherein said inner bracket member extends from said top side of said base member, wherein said inner bracket member comprises at least two side surfaces, wherein said at least two side surfaces are perpendicular to each other, and wherein said two side surfaces of said inner bracket member intersect at an inner bracket member edge; and an outer bracket member, wherein said outer bracket member extends from said top side of said base member, wherein said outer bracket member comprises at least two side surfaces, wherein said at least two side surfaces are perpendicular to each other, wherein said two side surfaces of said outer bracket member intersect at an outer bracket member edge, wherein said two side surfaces intersect at an outer bracket member edge, wherein said central bracket member is positioned substantially between at least a portion of said inner bracket member and said outer bracket member, and wherein said inner base member edge, two opposing central bracket member edges, said inner bracket member edge, and said outer bracket member edge are aligned;

wherein said inner bracket member is positioned such that side walls of said inner bracket member do not extend beyond side surfaces of said central bracket member that extend from a first central bracket member edge and said outer bracket member is positioned such that side walls of said outer bracket member do not extend beyond side surfaces of said central bracket member that extend from a second bracket member edge.

7. The outside corner bracket of claim 6, further comprising at least one base attachment aperture formed through said base member.

8. The outside corner bracket of claim 6, wherein said central bracket member is in the form of a cube.

9. The outside corner bracket of claim 6, wherein said inner bracket member and said bracket member are substantially L-shaped.

10. The outside corner bracket of claim 6, wherein legs of said inner bracket member and said outer bracket member are of said the length.

* * * * *